US011530565B2

(12) United States Patent
Morinaga et al.

(10) Patent No.: US 11,530,565 B2
(45) Date of Patent: Dec. 20, 2022

(54) ELEVATOR CAR DOOR APPARATUS

(71) Applicant: Mitsubishi Electric Corporation, Tokyo (JP)

(72) Inventors: Shogo Morinaga, Tokyo (JP); Masaya Kitazawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 109 days.

(21) Appl. No.: 16/967,733

(22) PCT Filed: May 22, 2018

(86) PCT No.: PCT/JP2018/019702
§ 371 (c)(1),
(2) Date: Aug. 6, 2020

(87) PCT Pub. No.: WO2019/224925
PCT Pub. Date: Nov. 28, 2019

(65) Prior Publication Data

US 2020/0362613 A1 Nov. 19, 2020

(51) Int. Cl.
*E05F 15/643* (2015.01)
*B66B 13/08* (2006.01)

(52) U.S. Cl.
CPC ..... *E05F 15/643* (2015.01); *B66B 13/08* (2013.01); *E05Y 2900/104* (2013.01)

(58) Field of Classification Search
CPC ... B66B 13/08; E05Y 2900/104; E05F 15/643
See application file for complete search history.

(56) References Cited

FOREIGN PATENT DOCUMENTS

| | | | | |
|---|---|---|---|---|
| CN | 101392617 | A | 3/2009 | |
| CN | 103492305 | A | 1/2014 | |
| CN | 203614682 | U | 5/2014 | |
| EP | 0182142 | A1 * | 5/1986 | |
| EP | 0918915 | B1 * | 5/2000 | |
| EP | 1396461 | A1 | 3/2004 | |
| GB | 2201192 | A * | 8/1988 | ..... E05F 15/643 |
| JP | 2001-187681 | A | 7/2001 | |
| JP | 2005-029328 | A | 2/2005 | |
| JP | 2008-074504 | A | 4/2008 | |

OTHER PUBLICATIONS

Machine Translation of EP 0 918 915.*

(Continued)

*Primary Examiner* — Diem M Tran
(74) *Attorney, Agent, or Firm* — Xsensus LLP

(57) ABSTRACT

An elevator car door apparatus includes a door frame, a door motor, a motor pulley, a reduction pulley, a first driving pulley, a second driving pulley, a reduction belt, and a driving belt. The door motor, the reduction pulley, and the first driving pulley are supported on the door frame by means of a unit supporting member. The unit supporting member includes a flat plate portion that is placed on a frame vertical surface of the door frame. The reduction pulley and the first driving pulley are rotatable around a fixed shaft that is fixed so as to be perpendicular to the flat plate portion.

13 Claims, 8 Drawing Sheets

(56) References Cited

OTHER PUBLICATIONS

International Search Report and Written Opinion dated Aug. 28, 2018 for PCT/JP2018/019702 filed on May 22, 2018, 9 pages including English Translation of the International Search Report.
Chinese Office Action dated Mar. 22, 2022 in counterpart Chinese Application No. 201880093481.1, 11 pages with English Translation.
Office Action dated Jul. 21, 2022, in corresponding Chinese patent Application No. 201880093481.1, 11 pages.

* cited by examiner

ELEVATOR CAR DOOR APPARATUS

CROSS-REFERENCE TO RELATED APPLICATION

The present application is based on PCT filing PCT/JP2018/019702, filed May 22, 2018, the entire contents of which are incorporated herein by reference.

TECHNICAL FIELD

The present invention relates to an elevator car door apparatus that includes a door motor that activates a car door.

BACKGROUND ART

In conventional elevator car door apparatuses, a beam is fixed to an upper portion of a car. A door motor and a pulley reduction gear are installed on an upper portion of the beam. A motor pulley is disposed on the door motor. The pulley reduction gear includes a large pulley and a small pulley. A driving pulley is disposed on the beam. A reduction belt is wound around the motor pulley and the large pulley. A driving belt is wound around the small pulley and the driving pulley (see Patent Literature 1, for example).

CITATION LIST

Patent Literature

[Patent Literature 1]
Japanese Patent Laid-Open No. 2005-29328 (Gazette)

SUMMARY OF THE INVENTION

Problem to be Solved by the Invention

In conventional elevator car door apparatuses such as that described above, the door motor and the pulley reduction gear are installed separately on the upper portion of the beam during installation. Because of that, alignment work between the motor pulley and the large pulley is time-consuming.

The present invention aims to solve the above problems and an object of the present invention is to provide an elevator car door apparatus that can simplify alignment work during installation.

Means for Solving the Problem

An elevator car door apparatus according to the present invention includes: a door frame that is fixed to a car above a car doorway, that includes a frame vertical surface, and that operates a car door; a door motor that includes: a rotating shaft that is perpendicular to the frame vertical surface; and a motor main body that rotates the rotating shaft, the door motor being supported on the door frame; a motor pulley that is fixed to the rotating shaft; a reduction pulley that is supported on the door frame; a first driving pulley that is supported on the door frame, the first driving pulley rotating together with the reduction pulley; a second driving pulley that is disposed on the door frame so as to be spaced apart from the first driving pulley in a width direction of the car doorway; a reduction belt that is wound around the motor pulley and the reduction pulley; and a driving belt that is wound around the first driving pulley and the second driving pulley, wherein: the door motor, the reduction pulley, and the first driving pulley are supported on the door frame by means of a unit supporting member; the unit supporting member includes a flat plate portion that is placed on the frame vertical surface; and the reduction pulley and the first driving pulley are rotatable around a fixed shaft that is fixed so as to be perpendicular to the flat plate portion.

Effects of the Invention

In the elevator car door apparatus according to the present invention, the door motor, the reduction pulley, and the first driving pulley are supported on the door frame by means of the unit supporting member. The reduction pulley and the first driving pulley are able to rotate around the fixed shaft that is fixed so as to be perpendicular to the flat plate portion of the unit supporting member. Because of that, time spent on alignment work during installation can be reduced.

DESCRIPTION OF EMBODIMENTS

Preferred embodiments of the present invention will now be explained with reference to the drawings.

Embodiment 1

Figure 1:
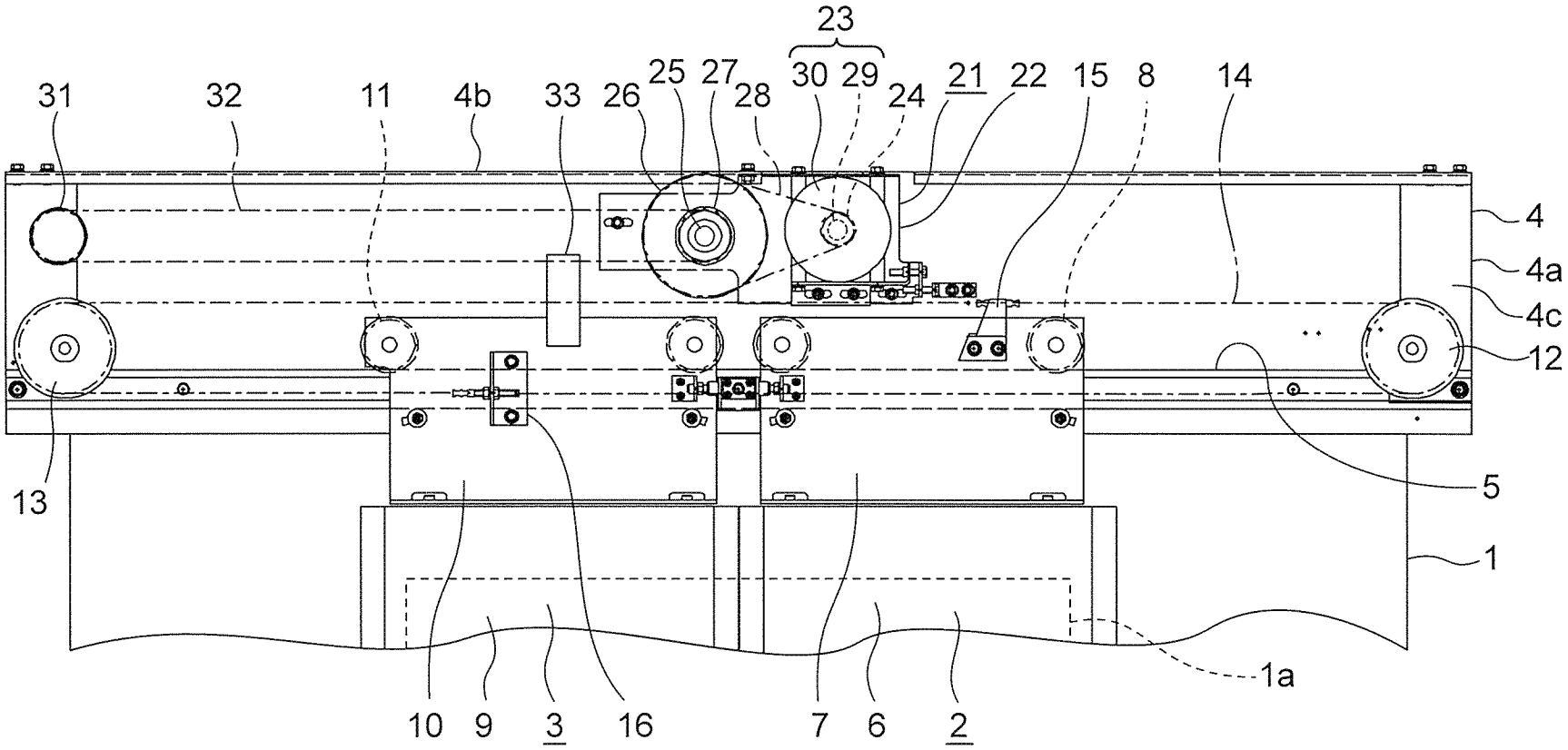
FIG. 1 is a front elevation that shows part of an elevator car door apparatus according to Embodiment 1 of the present invention.

FIG. 1 is a front elevation that shows part of an elevator car door apparatus according to Embodiment 1 of the present invention. In the figure, a car doorway 1*a* is disposed on a front surface of a car 1. The car doorway 1*a* is opened and closed by a first car door 2 and a second car door 3. The car door apparatus according to Embodiment 1 has two doors that open centrally.

A door frame 4 is fixed to an upper portion of the front surface of the car 1. The door frame 4 is disposed above the car doorway 1*a*. The door frame 4 includes a frame vertical portion 4*a* and a frame horizontal portion 4*b*. The frame vertical portion 4*a* is fixed to the car 1. The frame horizontal portion 4*b* protrudes from an upper end portion of the frame vertical portion 4*a* on an opposite side to the car 1, in other words, toward a landing side.

The frame vertical portion 4*a* includes a frame vertical surface 4*c*. The frame vertical surface 4*c* is a surface on the landing side of the frame vertical portion 4*a*. A door rail 5 is disposed on the frame vertical surface 4*c*. The door rail 5 guides opening and closing operations of the first car door 2 and the second car door 3. The first car door 2 and the second car door 3 are suspended from the door rail 5.

The first car door 2 includes a first door panel 6 and a first door hanger 7. The first door hanger 7 is fixed to an upper end portion of the first door panel 6. A pair of first hanger rollers 8 are disposed on the first door hanger 7.

The second car door 3 includes a second door panel 9 and a second door hanger 10. The second door hanger 10 is fixed to an upper end portion of the second door panel 9. A pair of second hanger rollers 11 are disposed on the second door hanger 10.

During the opening and closing operations of the first car door 2 and the second car door 3, the first hanger rollers 8 and the second hanger rollers 11 move while rolling along the door rail 5.

A first interlocking pulley 12 is disposed on an end portion of the door frame 4 that is near the first car door 2. A second interlocking pulley 13 is disposed on an end portion of the door frame 4 that is near the second car door 3.

An interlocking body 14 is wound onto the first interlocking pulley 12 and the second interlocking pulley 13. The interlocking body 14 is disposed in an annular shape around the first interlocking pulley 12 and the second interlocking pulley 13. The interlocking body 14 is a member that has flexibility, and may be an interlocking rope, for example.

The first door hanger 7 is connected to an upper portion of the interlocking body 14 by means of a first connecting member 15. The second door hanger 10 is connected to a lower portion of the interlocking body 14 by means of a second connecting member 16. The first car door 2 and the second car door 3 move in opposite directions to each other due to the interlocking body 14 operating cyclically.

A motor unit 21 is supported on the door frame 4 centrally in the width direction of the car doorway 1*a*. The motor unit 21 includes a unit supporting member 22, a door motor 23, a motor pulley 24, a fixed shaft 25, a reduction pulley 26, a first driving pulley 27, and an annular reduction belt 28.

The unit supporting member 22 is mounted centrally on the door frame 4. In other words, the unit supporting member 22 overlaps centrally with the door frame 4 in the width direction of the car doorway 1*a*.

The door motor 23, the motor pulley 24, the fixed shaft 25, the reduction pulley 26, the first driving pulley 27, and the reduction belt 28 are supported on the door frame 4 by means of the unit supporting member 22.

The door motor 23 includes: a rotating shaft 29; and a motor main body 30 that rotates the rotating shaft 29. The door motor 23 generates a driving force that operates the first car door 2 and the second car door 3. The motor pulley 24 is fixed to the rotating shaft 29.

The fixed shaft 25 is fixed to the unit supporting member 22. The fixed shaft 25 is disposed so as to be spaced apart from the door motor 23 in the width direction of the car doorway 1*a*. The fixed shaft 25 and the rotating shaft 29 are parallel to each other and horizontal. The reduction pulley 26 and the first driving pulley 27 are rotatable around the fixed shaft 25.

The reduction pulley 26 is disposed so as to be spaced apart from the motor pulley 24 in the width direction of the car doorway 1*a*. A diameter of the reduction pulley 26 is larger than a diameter of the motor pulley 24. The reduction belt 28 is wound around the motor pulley 24 and the reduction pulley 26.

The first driving pulley 27 rotates together with the reduction pulley 26. A diameter of the first driving pulley 27 is smaller than the diameter of the reduction pulley 26.

A second driving pulley 31 is disposed on an end portion of the door frame 4 that is near the second car door 3. The second driving pulley 31 is disposed so as to be spaced apart from the first driving pulley 27 in the width direction of the car doorway 1*a*. The second driving pulley 31 is disposed above the second interlocking pulley 13.

An annular driving belt 32 is wound around the first driving pulley 27 and the second driving pulley 31. The second door hanger 10 is connected to a lower portion of the driving belt 32 by means of a belt connecting member 33.

The motor pulley 24 rotates together with the rotating shaft 29. The rotation of the motor pulley 24 is transmitted to the reduction pulley 26 by means of the reduction belt 28. The first driving pulley 27 rotates together with the reduction pulley 26. When the first driving pulley 27 rotates, the driving belt 32 operates cyclically, and the second car door 3 performs an opening or closing operation.

The opening and closing operations of the second car door 3 are transmitted to the first car door 2 by means of the interlocking body 14. The first car door 2 thereby performs opening and closing operations together with the second car door 3.

Figure 2:
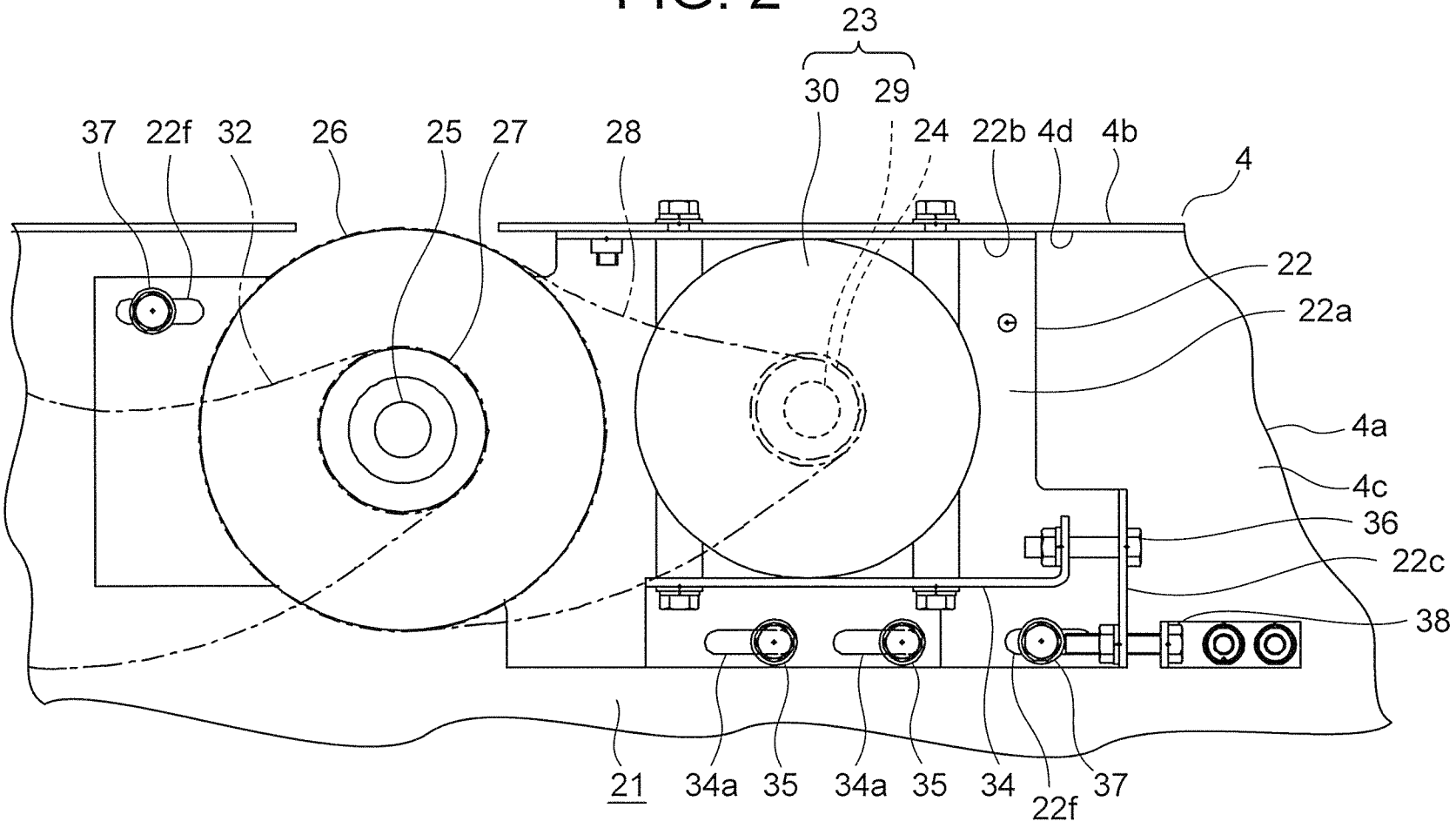
FIG. 2 is a front elevation that shows an intermediate state during installation of a motor unit from FIG. 1.
Figure 3:
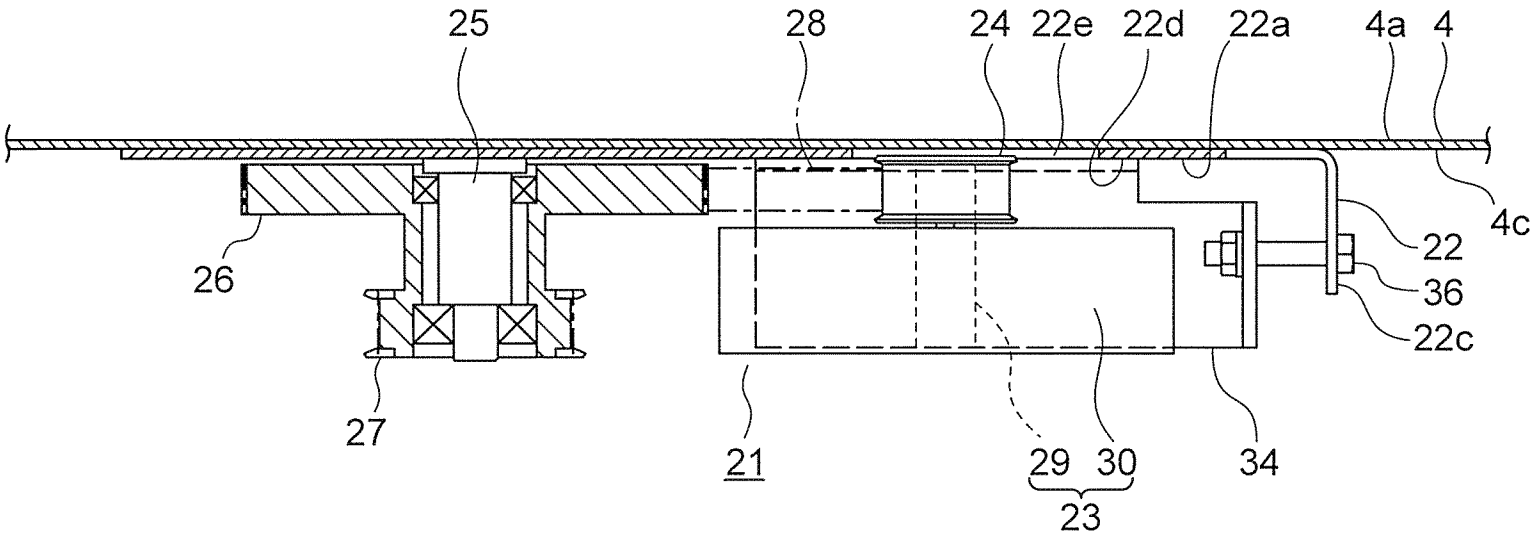
FIG. 3 is a cross section of the motor unit in FIG. 2.

FIG. 2 is a front elevation that shows an intermediate state during installation of the motor unit 21 from FIG. 1. FIG. 3 is a cross section of the motor unit 21 in FIG. 2. Moreover, in FIG. 3, the door motor 23 and the motor pulley 24 are depicted in outline rather than in cross section.

The frame horizontal portion 4*b* includes a frame horizontal surface 4*d*. The frame horizontal surface 4*d* is a lower surface of the frame horizontal portion 4*b*.

The unit supporting member 22 includes a flat plate portion 22*a*, a unit horizontal portion 22*b*, and a protruding portion 22*c*. The flat plate portion 22*a* is placed on the frame vertical surface 4*c* so as to be in surface contact therewith. The unit horizontal portion 22*b* is placed on the frame horizontal surface 4*d* so as to be in surface contact therewith. The protruding portion 22*c* protrudes perpendicularly from an end portion of the flat plate portion 22*a* near the door motor 23 away from the door frame 4.

The door motor 23 is mounted to the unit supporting member 22 by means of a motor supporting member 34. The flat plate portion 22*a* includes a motor reference surface 22*d*. The motor reference surface 22*d* is a surface of the flat plate portion 22*a* on an opposite side from the frame vertical surface 4*c*. The motor supporting member 34 is placed on the motor reference surface 22*d* so as to be in surface contact therewith.

The rotating shaft 29 is disposed so as to be perpendicular to the frame vertical surface 4*c*. The fixed shaft 25 is fixed so as to be perpendicular to the flat plate portion 22*a*.

The motor main body 30 is disposed so as to be spaced apart from the flat plate portion 22*a*. The motor pulley 24 is disposed on a side of the motor main body 30 near the flat plate portions 22*a*. The reduction pulley 26 is disposed on a side of the first driving pulley 27 near the flat plate portion 22*a*. When viewed parallel to the car doorway 1*a*, the first driving pulley 27 overlaps with the motor main body 30.

An opening 22*e* is disposed in the flat plate portion 22*a*. An end portion of the motor pulley 24 at an opposite end from the motor main body 30 is inserted into the opening 22*e*. In other words, the opening 22*e* frees the end portion of the motor pulley 24 and prevents interference between the flat plate portion 22*a* and the motor pulley 24.

The motor supporting member 34 is fixed to the unit supporting member 22 using a plurality of first fastening devices 35. A plurality of first slots 34*a* that allow passage of the first fastening devices 35 are disposed on the motor supporting member 34.

The motor supporting member 34 is movable along the motor reference surface 22*d* in the width direction of the car doorway 1*a* by loosening all of the first fastening devices 35.

In other words, a mounted position of the motor supporting member 34 is adjustable relative to the unit supporting member 22 in the width direction of the car doorway 1*a*.

A mounted position of the door motor 23 is thereby adjustable relative to the unit supporting member 22 in the width direction of the car doorway 1*a*.

A reduction belt tensioner 36 that adjusts tension in the reduction belt 28 is disposed between the motor supporting member 34 and the protruding portion 22*c*.

The unit supporting member 22 is fixed to the door frame 4 using a plurality of second fastening devices 37. A plurality of second slots 22*f* that allow passage of the second fastening devices 37 are disposed on the unit supporting member 22.

The unit supporting member 22 is movable along the frame vertical surface 4*c* and the frame horizontal surface 4*d* in the width direction of the car doorway 1*a* by loosening all of the second fastening devices 37. In other words, a mounted position of the unit supporting member 22 is adjustable relative to the door frame 4 in the width direction of the car doorway 1*a*.

A driving belt tensioner 38 that adjusts tension in the driving belt 32 is disposed between the protruding portion 22*c* and the door frame 4. In other words, the reduction belt tensioner 36 and the driving belt tensioner 38 are disposed on a shared protruding portion 22*c*.

Jack bolts, for example, can be used for the reduction belt tensioner 36 and the driving belt tensioner 38. The motor unit 21 according to Embodiment 1 further includes the motor supporting member 34, the first fastening devices 35, the reduction belt tensioner 36, the second fastening devices 37, and the driving belt tensioner 38.

The position of the unit supporting member 22 relative to the door frame 4 and the position of the door motor 23 relative to the unit supporting member 22 are adjustable independently from each other. Thus, the tension of the reduction belt 28 and the tension of the driving belt 32 are adjustable independently from each other.

FIG. 2 shows a state before the tension of the reduction belt 28 and the driving belt 32 are adjusted, the reduction belt 28 and the driving belt 32 being slack.

Figure 4:
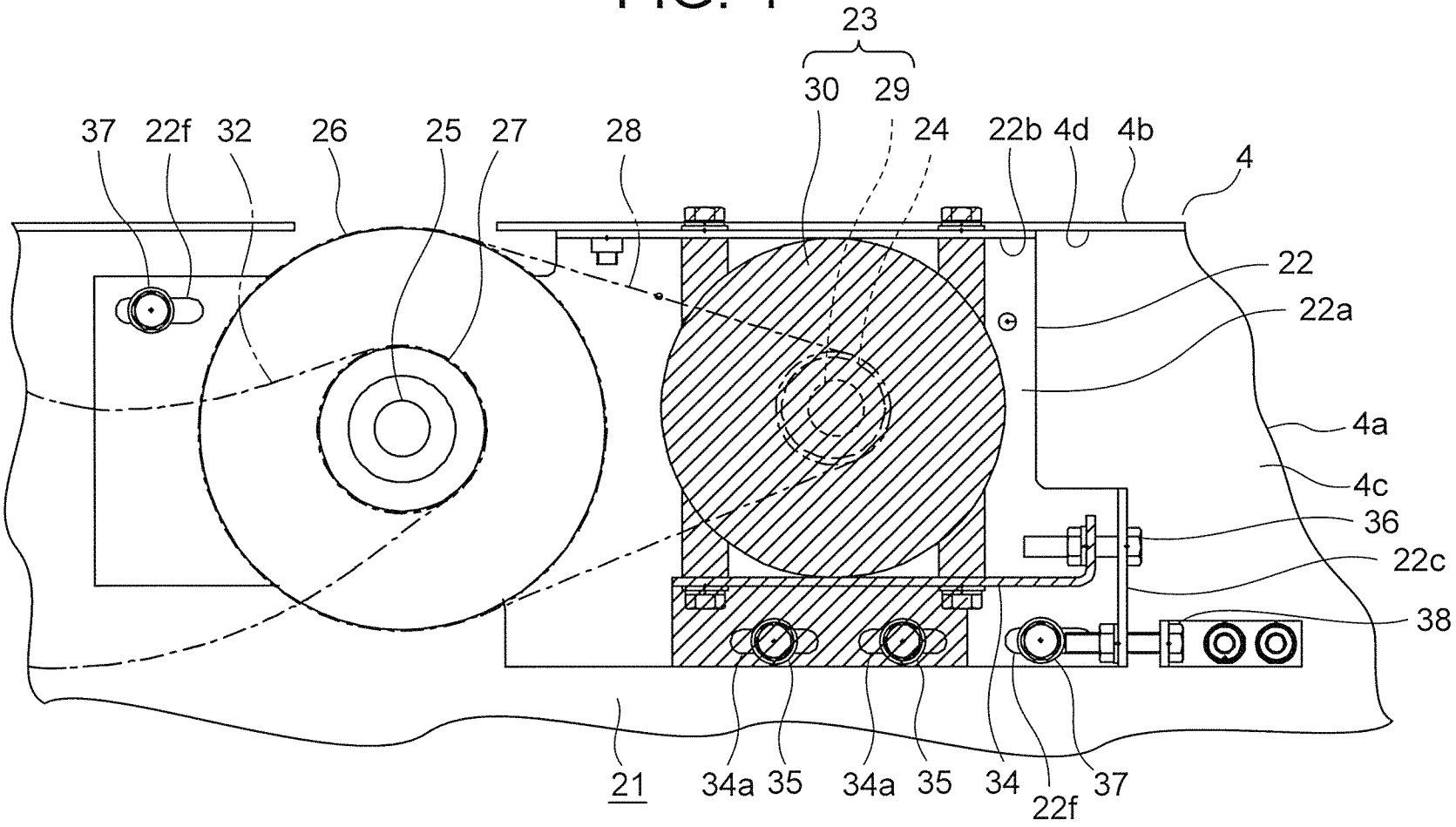
FIG. 4 is a front elevation that shows a state in which tension of a reduction belt from FIG. 2 is adjusted.
Figure 5:
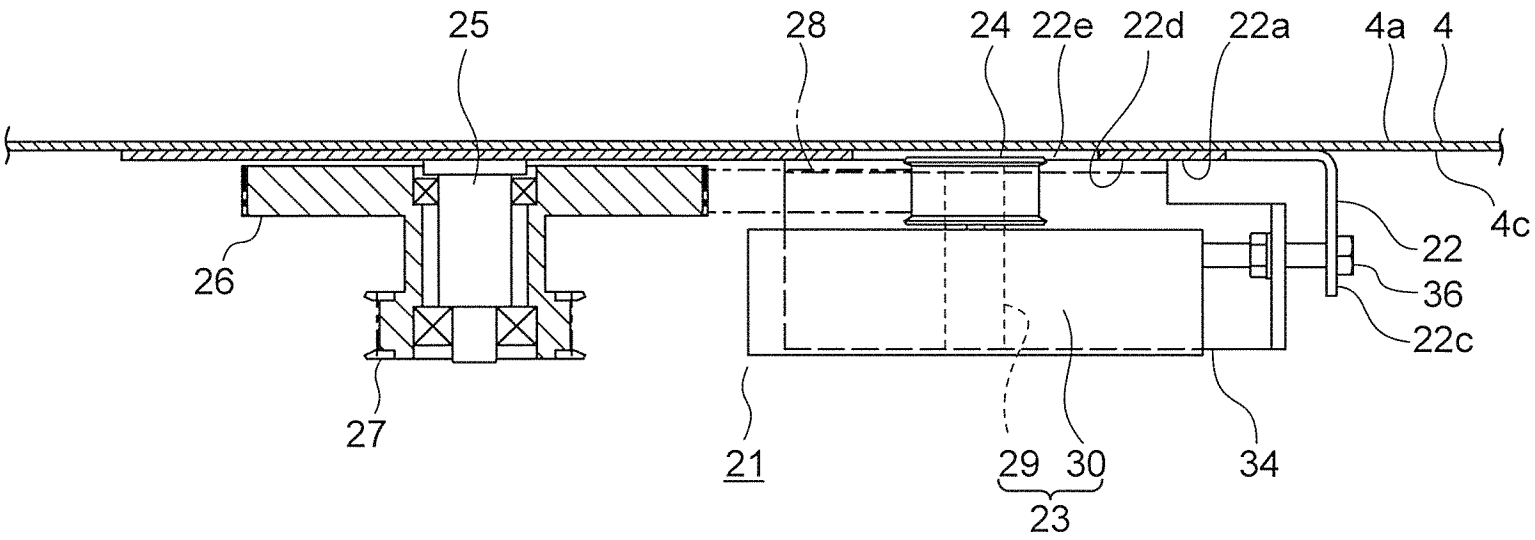
FIG. 5 is a cross section of the motor unit in FIG. 4.

From this state, the motor supporting member 34 is moved away from the reduction pulley 26 relative to the unit supporting member 22, as shown in FIGS. 4 and 5, by operating the reduction belt tensioner 36. In other words, the hatched portion in FIG. 4 is pulled to the right in FIG. 4.

Next, the motor supporting member 34 is fixed to the unit supporting member 22 by fastening the first fastening devices 35. Slack in the reduction belt 28 is thereby removed, and the tension of the reduction belt 28 is adjusted to within an appropriate range.

Figure 6:
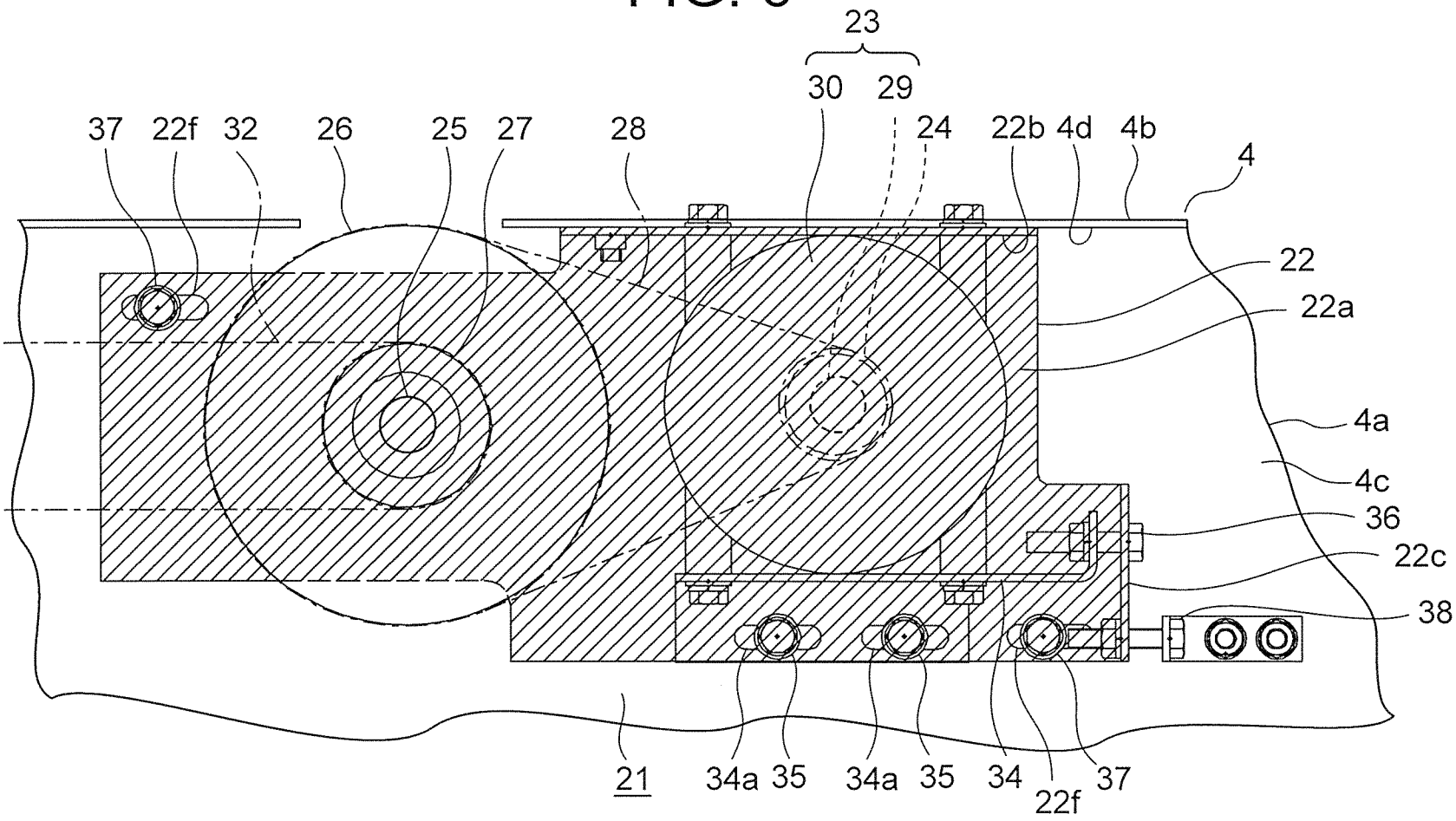
FIG. 6 is a front elevation that shows a state in which tension of a driving belt from FIG. 4 is adjusted.

From the state in FIG. 4, the unit supporting member 22 is moved away from the second driving pulley 31 by operating the driving belt tensioner 38. In other words, the hatched portion in FIG. 6 is pulled to the right in FIG. 6.

Next, the unit supporting member 22 is fixed to the door frame 4 by fastening the second fastening devices 37. Slack in the driving belt 32 is thereby removed, and the tension of the driving belt 32 is adjusted to within an appropriate range.

During tension adjustment of the driving belt 32, the entire motor unit 21 moves, and the positional relationship between the door motor 23 and the reduction pulley 26 within the motor unit 21 does not change.

Moreover, tension adjustment of the reduction belt 28 and tension adjustment of the driving belt 32 may be performed in any order during installation. During maintenance, only the tension of one or the other of the reduction belt 28 and the driving belt 32 may alternatively be adjusted.

In an elevator car door apparatus of this kind, a door motor 23, a reduction pulley 26, and a first driving pulley 27 are supported on a door frame 4 by means of a unit supporting member 22. A fixed shaft 25 is fixed perpendicularly to a flat plate portion 22*a* of the unit supporting member 22. The reduction pulley 26 and a first driving pulley 27 are able to rotate around the fixed shaft 25.

Because of that, time spent on alignment work during installation can be reduced by fixing the fixed shaft 25 perpendicularly to the unit supporting member 22 in advance, and installing the door motor 23, the reduction pulley 26, and the first driving pulley 27 on the unit supporting member 22 in advance.

A motor pulley 24 is disposed on a side of a motor main body 30 near the flat plate portion 22*a*, and the reduction pulley 26 is disposed on a side of the first driving pulley 27 near the flat plate portion 22*a*. Thus, the first driving pulley 27 can be disposed so as to overlap with the motor main body 30 when viewed parallel to the width direction of a car doorway 1*a*.

Because of that, an axial dimension of the assemblage of the door motor 23 and the motor pulley 24 and an axial dimension of the assemblage of the fixed shaft 25, the reduction pulley 26, and the first driving pulley 27 can be made similar or identical. Thus, a thin door frame 4 can be used.

Because an opening 22*e* that frees the motor pulley 24 is disposed on the flat plate portion 22*a*, an even thinner door frame 4 can be used.

Because the mounted position of the unit supporting member 22 and the mounted position of the door motor can be adjusted independently from each other, efficiency of installation work can be improved. Efficiency of maintenance work can also be improved.

The flat plate portion 22*a* is placed on the frame vertical surface 4*c*. Because of that, the tension of the driving belt 32 can be easily adjusted while keeping the shaft of the first driving pulley 27 and the shaft of the second driving pulley 31 parallel to each other by moving the unit supporting member 22 along the frame vertical surface 4*c*.

The door motor 23 is mounted to the door frame 4 by means of a motor supporting member 34. Because of that, the door frame 4 can be made thinner while ensuring rigidity of the door motor 23 when mounted.

The motor supporting member 34 is placed on the motor reference surface 22*d*. Because of that, the tension of the reduction belt 28 can be easily adjusted while keeping the rotating shaft 29 parallel to the fixed shaft 25, by moving the motor supporting member 34 along the motor reference surface 22*d*.

A reduction belt tensioner 36 is disposed between the motor supporting member 34 and the unit supporting member 22. Because of that, the tension of the reduction belt 28 can be easily adjusted.

A driving belt tensioner 38 is disposed between the unit supporting member 22 and the door frame 4. Because of that, the tension of the driving belt 32 can be easily adjusted.

The reduction belt tensioner 36 and the driving belt tensioner 38 are disposed on the shared protruding portion 22*c*. Because of that, adjustment of the tension of the reduction belt 28 and the driving belt 32 can be performed at an identical position, enabling workability to be improved.

The unit supporting member 22 is disposed centrally on the door frame 4 in the width direction of the car doorway 1*a*. Because of that, workability can be improved during installation work and maintenance work.

Embodiment 2

Figure 7:
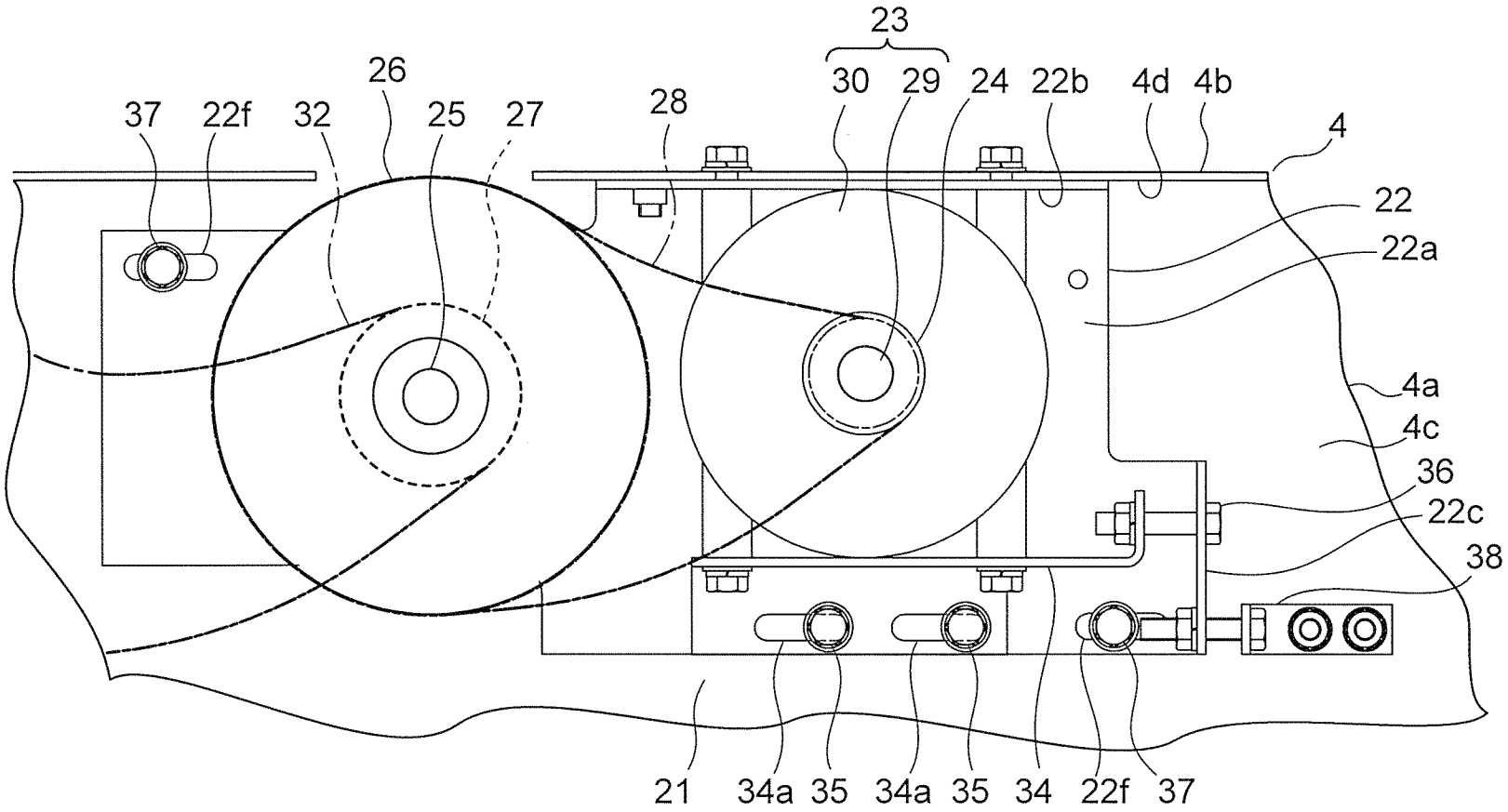
FIG. 7 is a front elevation that shows a motor unit according to Embodiment 2 of the present invention.
Figure 8:
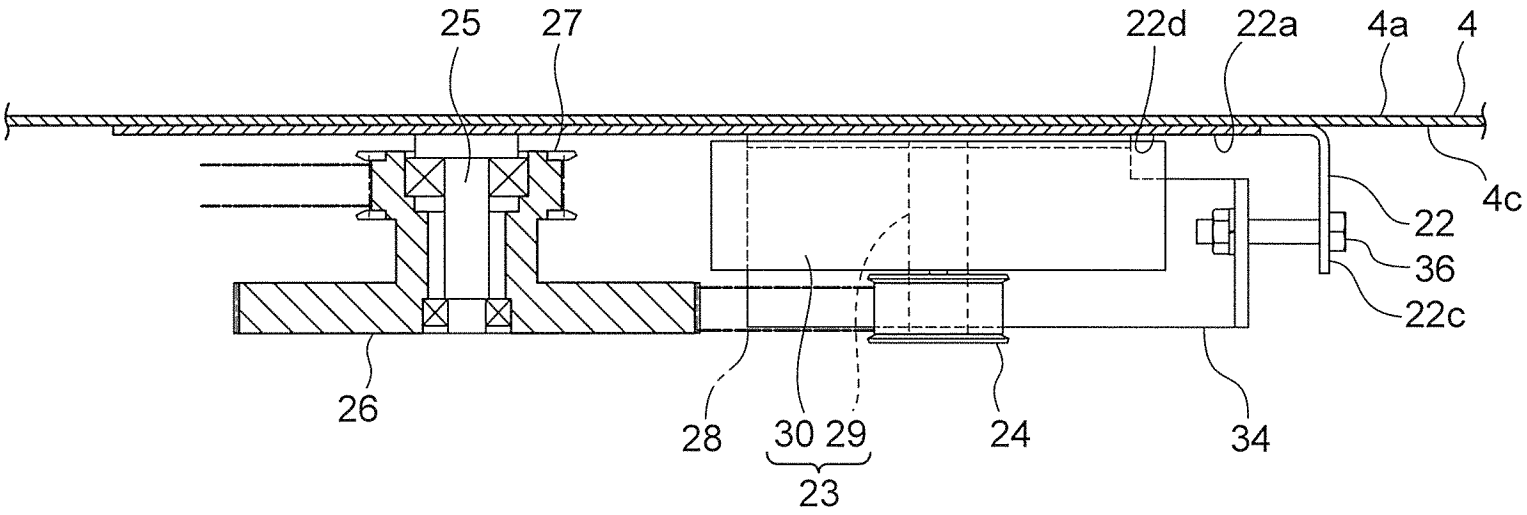
FIG. 8 is a cross section of the motor unit in FIG. 7.

Next, FIG. 7 is a front elevation that shows a motor unit 21 according to Embodiment 2 of the present invention, and corresponds to FIG. 2 according to Embodiment 1. FIG. 8 is a cross section of the motor unit 21 in FIG. 7.

In Embodiment 2, a motor pulley 24 is disposed so as to be spaced apart from a flat plate portion 22*a*. A motor main body 30 is disposed on a side of the motor pulley 24 near the flat plate portion 22*a*. In other words, the motor pulley 24 is disposed on a landing side of the motor main body 30. Together with this, a first driving pulley 27 is disposed on a side of a reduction pulley 26 near the flat plate portion 22*a*. In other words, the reduction pulley 26 is disposed on a landing side of the first driving pulley 27. A remainder of the configuration is similar or identical to that of Embodiment 1.

Similar or identical effects to those of Embodiment 1 can also be achieved using this kind of configuration.

Moreover, in Embodiment 2, an opening 22*e* that frees the end portion of the motor main body 30 at an opposite end from the motor pulley 24 may alternatively be disposed on the flat plate portion 22*a*, and the end portion of the motor main body 30 inserted into the opening. A thinner door frame 4 can thereby be used.

In Embodiments 1 and 2, the door motor 23 is disposed to the right of the reduction pulley 26 when viewed from a landing. However, the position of the door motor 23 relative to the reduction pulley 26 is not limited to the above example, and may alternatively be reversed, for example.

Furthermore, the present invention can also be applied to a unidirectionally opening car door apparatus. In a unidirectionally opening car door apparatus, a motor unit 21 is disposed on first longitudinal end portion of a door frame 4.

Furthermore, the number of car doors may alternatively be one, or may be three or more.

EXPLANATION OF NUMBERING

1 CAR; 1*a* CAR DOORWAY; 2 FIRST CAR DOOR; 3 SECOND CAR DOOR; 4 DOOR FRAME; 4*c* FRAME VERTICAL SURFACE; 22 UNIT SUPPORTING MEMBER; 22*a* FLAT PLATE PORTION; 22*c* PROTRUDING PORTION; 22*d* MOTOR REFERENCE SURFACE; 22*e* OPENING; 23 DOOR MOTOR; 24 MOTOR PULLEY; 25 FIXED SHAFT; 26 REDUCTION PULLEY; 27 FIRST DRIVING PULLEY; 28 REDUCTION BELT; 29 ROTATING SHAFT; 30 MOTOR MAIN BODY; 31 SECOND DRIVING PULLEY; 32 DRIVING BELT; 34 MOTOR SUPPORTING MEMBER; 36 REDUCTION BELT TENSIONER; 38 DRIVING BELT TENSIONER.

The invention claimed is:

1. An elevator car door apparatus comprising:

a door frame that is fixed to a car above a car doorway, that includes a frame vertical surface, and that operates a car door;

a door motor that includes:

a rotating shaft that is perpendicular to the frame vertical surface; and a motor main body that rotates the rotating shaft, the door motor being supported on the door frame;

a motor pulley that is fixed to the rotating shaft;

a reduction pulley that is supported on the door frame;

a first driving pulley that is supported on the door frame, the first driving pulley rotating together with the reduction pulley;

a second driving pulley that is disposed on the door frame so as to be spaced apart from the first driving pulley in a width direction of the car doorway;

a reduction belt that is wound around the motor pulley and the reduction pulley; and a driving belt that is wound around the first driving pulley and the second driving pulley, wherein:

the door motor, the reduction pulley, and the first driving pulley are supported on the door frame by means of a unit supporting member, the unit supporting member includes a flat plate portion that is placed on the frame vertical surface, the reduction pulley and the first driving pulley are rotatable around a fixed shaft that is fixed so as to be perpendicular to the flat plate portion, and the motor main body and the motor pulley are disposed on a same side of the flat plate portion.

2. The elevator car door apparatus according to claim 1, wherein:

the motor pulley is disposed on a side of the motor main body near the flat plate portion;

the reduction pulley is disposed on a side of the first driving pulley near the flat plate portion.

3. The elevator car door apparatus according to claim 2, wherein an opening that frees an end portion of the motor pulley at an opposite end from the motor main body is disposed on the flat plate portion.

4. The elevator car door apparatus according to claim 2, wherein the first driving pulley overlaps with the motor main body when viewed parallel to the width direction of the car doorway.

5. The elevator car door apparatus according to claim 1, wherein the unit supporting member overlaps a center of the door frame in the width direction of the car doorway.

6. The elevator car door apparatus according to claim 1, wherein:

the motor main body is disposed on a side of the motor pulley near the flat plate portion; and the first driving pulley is disposed on a side of the reduction pulley near the flat plate portion.

7. The elevator car door apparatus according to claim 6; wherein an opening that frees an end portion of the motor main body at an opposite end from the motor pulley is disposed on the flat plate portion.

8. The elevator car door apparatus according to claim 6, wherein the first driving pulley overlaps with the motor main body when viewed parallel to the width direction of the car doorway.

9. The elevator car door apparatus according to claim 1, wherein:

a mounted position of the unit supporting member is adjustable in the width direction of the car doorway relative to the door frame; and a mounted position of the door motor is adjustable in the width direction of the car doorway relative to the unit supporting member independently from the adjustment of the mounted position of the unit supporting member relative to the door frame.

10. The elevator car door apparatus according to claim 9, wherein:

the door motor is mounted to the unit supporting member by means of a motor supporting member;

the motor supporting member is placed on a motor reference surface, the motor reference surface being a surface on an opposite side of the flat plate portion from the frame vertical surface; and the mounted position of the motor supporting member is adjustable in the width direction of the car doorway relative to the unit supporting member, the mounted position of the door motor thereby being adjustable in the width direction of the car doorway relative to the unit supporting member.

11. The elevator car door apparatus according to claim 10, wherein a reduction belt tensioner that adjusts tension in the reduction belt is disposed between the motor supporting member and the unit supporting member.

12. The elevator car door apparatus according to claim 11, wherein:

a protruding portion that protrudes away from the door frame is disposed on an end portion of the unit supporting member near the door motor;

the reduction belt tensioner is disposed between the unit supporting member and the protruding portion; and a driving belt tensioner that adjusts tension in the driving belt is disposed between the protruding portion and the door frame.

13. The elevator car door apparatus according to claim 9, wherein a driving belt tensioner that adjusts tension in the driving belt is disposed between the unit supporting member and the door frame.

* * * * *